United States Patent [19]

Jeschke et al.

[11] Patent Number: 4,828,745

[45] **Date of Patent: * May 9, 1989**

[54] MULTILAYER DETERGENT IN BLOCK FORM

[75] Inventors: Peter Jeschke, Neuss; Theodor Altenschoepfer, Duesseldorf; Jochen Jacobs, Wuppertal, all of Fed. Rep. of Germany

[73] Assignee: Henkel Kommanditgesellschaft auf Aktien, Duesseldorf, Fed. Rep. of Germany

[ * ] Notice: The portion of the term of this patent subsequent to May 9, 2006 has been disclaimed.

[21] Appl. No.: 931,502

[22] Filed: Nov. 17, 1986

[30] Foreign Application Priority Data

Nov. 21, 1985 [DE] Fed. Rep. of Germany ..... 3541153

[51] Int. Cl.[4] ..... C11D 7/36; C11D 17/00; C11D 7/14; C11D 7/116

[52] U.S. Cl. ..... 252/99; 252/174; 252/174.21; 252/DIG. 16; 252/91; 252/135

[58] Field of Search ..... 252/174, 135, 156, 174.21, 252/DIG. 16, 99; 134/25.2, 29

[56] References Cited

U.S. PATENT DOCUMENTS

| | | | |
|---|---|---|---|
| 2,412,819 | 12/1946 | MacMahon | 252/138 |
| 3,390,092 | 6/1968 | Keast et al. | 252/99 |
| 4,219,436 | 8/1980 | Gromer et al. | 252/135 |
| 4,518,516 | 5/1985 | Godard | 252/174 |

FOREIGN PATENT DOCUMENTS

| | | |
|---|---|---|
| 0003769 | 9/1978 | European Pat. Off. . |
| 0000076 | 12/1978 | European Pat. Off. . |
| 3519354.9 | 5/1985 | Fed. Rep. of Germany . |

*Primary Examiner*—Paul Lieberman
*Assistant Examiner*—John F. McNally
*Attorney, Agent, or Firm*—Ernest G. Szoke; Wayne C. Jaeschke; Real J. Grandmaison

[57] ABSTRACT

A block-form detergent composition for dishwashing machines based on alkali metal metasilicates, pentaalkali metal triphosphates, active chlorine compound, and surfactant. The block-form detergent composition comprises a cold water-soluble layer (1) comprising alkali metal metasilicates, and a warm water-soluble layer (2) comprising alkali metal metasilicates and pentaalkali metal triphosphate. The layer (1) and layer (2) are formed as separate melts, one melt is poured into a mold to cool and partially solidify, and the other melt added to the mold whereby the layers fuse to each other. In use, the layer (1) and layer (2) have different dissolving rates in the time-temperature program of the dishwashing machines.

12 Claims, No Drawings

MULTILAYER DETERGENT IN BLOCK FORM

BACKGROUND OF THE INVENTION

Field of the Invention

This invention relates to multilayer detergents in lock form, more especially for dishwashing machines; to a process for producing the detergents; and to the use of the detergents in the automatic prerinse and main wash cycle of domestic dishwashing machines (DDWM).

Heretofore, it has been standard practice to introduce the detergents used for dishwashing in DDWM, irrespective of their aggregate state and/or their form, through a dispenser generally accommodated in the door of the machine which automatically opens when the main wash cycle is reached after the prerinse cycle, so that the automatically heated tapwater flowing in is able to take up and dissolve the detergent. The detergent is required to dissolve as quickly as possible so that it is available throughout the wash cycle. The prerinse cycle is only used for cleaning to the extent that soil loosely adhering to dishes is removed by the water circulation mechanics. No detergent is used in the prerinse cycle.

It is known from institutional dishwashing, for example in large kitchens, that the main-wash detergent, which is carried over into the so-called preliminary clearing zone which corresponds to a prerinse cycle by the continuous operation of the machine on the countercurrent principle, is used in that zone for the supportive removal of adhering food remains. A detergent-containing preliminary clearing zone is more effective than a preliminary clearing zone merely supplied with fresh water. However, the detergents used in this field are very strongly alkaline, containing above all alkali metal hydroxides. The pH value at normal in-use concentrations is above about 12.

Although it would be possible to introduce a known dishwashing detergent into the dispenser of the machine for the main wash cycle and to add a second detergent dissolving rapidly in cold water in any way to the prerinse cycle, this would require two detergents of different composition which would not only be inconvenient, it could also give rise to confusion is use.

DISCUSSION OF RELATED ART

U.S. Pat. No. 2,412,819 describes briquetted detergents for dishwashing machines which are produced simply by mixing together all the alkaline-reacting active substances such as, for example, up to 65% by weight, based on the detergent as a whole, of sodium silicates and pentasodium triphosphate and, if necessary, water if the preferred water of hydration of the compounds mentioned is not sufficient, and then gently heating the mixture with stirring to 90°–100° C. until a uniformly molten mass is obtained, subsequently pouring the melt thus formed into molds and leaving it to solidify into a compact crystal aggregate. No addition of active chlorine donors are mentioned in U.S. Pat. No. 2,412,819. This is understandable because the detergents themselves are strongly alkaline and, like many substances which it would be desirable to add, but which are sensitive to alkali, the active chlorine donors would be inactivated during the actual dissolving process. Irrespective of their dissolving behavior, therefore, detergents such as these are unsuitable for use in domestic dishwashing machines.

Detergents in the form of fused blocks for dishwashing machines are also described in European patent application No. 3 769. In most cases, they contain large amounts of alkali hydroxides. However, Example 8 therein discloses a composition which is free from alkali metal hydroxides. Although in that case the active chlorine donor is directly stirred into the subsequently solidifying aqueous solution of the ingredients, it is generally added in the form of a separate core. In this example, the active substance content is only 60% by weight, based on the detergent as a whole, which is too low for use in domestic dishwashing machines. Since the patent specification repeatedly mentions, even in comparison tests, the well-known sensitivity of active chlorine donors to alkalis, it could not be assumed that active chlorine donors would lend themselves to direct incorporation in strongly alkaline block-form detergents free from alkali metal hydroxides.

By contrast, earlier German Patent Application P No. 35 119 354.9 describes block-form detergents free from alkali metal hydroxides for dishwashing machines containing from 65 to 85% by weight, based on the detergent as a whole, of a mixture of alkali metal silicates and pentaalkali metal triphosphates and a homogeneously distributed content of active chlorine donors. However, these detergents do not have the optimal solubility behavior for the purpose according to the invention.

Now, the object of the present invention, above all with the increasing manufacture of energy-saving dishwashing machines in mind, is to develop a detergent which supports the washing process, even in the prerinse cycle of a domestic dishwashing machine. Since the prerinse cycle, which takes place at the temperature at which the tapwater flows in, lasts only a few minutes, the detergent must dissolve as quickly as possible.

The detergent should not be too strongly alkaline because this is not permitted in the domestic sector both for reasons of health and for reasons of damage to decorative finishes. Accordingly, the pH-value should not be any higher than 12. No free caustic alkali metal salt should be present.

DESCRIPTION OF THE INVENTION

It has now been found that block-form detergents, which overall show different solubilities for different periods and at different water temperatures in the prerinse cycle and in the main wash cycle, provided by two or more differently acting layers, are suitable for simultaneous use in the pre-rinse cycle and main wash cycle of dishwashing machines.

Other than in the operating examples, or where otherwise indicated, all numbers expressing quantities of ingredients or reaction conditions used herein are to be understood as modified in all instances by the term "about."

Accordingly, the present invention relates for the first time to detergents in the form of fused blocks, more especially detergents for dishwashing machines, containing standard alkaline components, more especially from the group consisting of alkali metal metasilicates and pentaalkali metal triphosphates, and also standard additives of the active chlorine donor, surfactant and/or electrolyte type, characterized in that they are in the form of multi-layer fused blocks preferably two-layer structures, and in that the layers differ in their dissolving rate in the time-temperature program of the dishwashing machine.

The detergent layer for the prerinse cycle comprises cold water-soluble alkali metal donors, more especially alkali metal metasilicates having different degrees of hydration which incipiently soften and thoroughly wet dried-on food remains which cannot be removed from the dishes by the water mechanics alone. This layer has a dissolving rate in flowing water at 15° C. of from 25 to 40 and preferably from 28 to 38 grams per hour.

The alkaline metasilicates, preferably sodium metasilicates, of the layer intended for the prerinse cycle are used in the anhydrous and, hence, most strongly alkaline form and in the form of the nonahydrate, the most readily soluble form. The mixture may also contain portions of the metasilicate pentahydrate. The prerinse detergent layer comprises from 20 to 100% by weight and preferably from 30 to 80% by weight of sodium metasilicate nonahydrate, from 0 to 60% by weight and preferably from 10 to 50% by weight of sodium metasilicate pentahydrate and, to obtain greater alkalinity, from 0 to 60% by weight and preferably from 10 to 58% by weight of anhydrous sodium metasilicate.

Electrolytes may be added to the prerinse layer in order further to improve solubility and also to optimize costs. Electrolytes are understood to be alkali metal salts of inorganic or organic acids, such as for example pentasodium triphosphate, sodium sulfate, sodium acetate and sodium citrate. They may make up from 2 to 10% by weight and preferably from 2 to 5% by weight of the total weight of the detergent layer intended for the prerinse cycle.

The layer for the main wash cycle preferably contains for the most part sodium metasilicates and anhydrous pentasodium triphosphate and, in addition, other washing-active substances, such as for example an active chlorine compound. Their dissolving rate in flowing water at 15 ° C. is preferably below 25 grams per hour and more especially in the range of from 24.5 to 15 grams per hour.

The anhydrous pentaalkali metal triphospahte, preferably pentasodium triphosphate, for the main wash detergent layer is added in a quantity of from 5 to 50% by weight, and preferably in a quantity of from 5 to 45% by weight, based on the weight of that layer.

The alkali metal metasilicates in the main-wash detergent layer with the lower dissolving rate at lower water temperatures are advantageously used in the form of sodium metasilicate nonahydrate, sodium metasilicate hexahydrate, and sodium metasilicate pentahydrate. They are used in quantities of from 5 to 60% by weight, and preferably in quantities of from 10 to 50% by weight, based on anhydrous compounds and based on the weight of the layer provided for the main wash cycle. However, anhydrous compounds may also be added, thus increasing the content of washing-active substances.

The optimal ratio by weight of pentasodium triphosphate to sodium metasilicate (both in anhydrous form) for the main-wash layer is from 2:1 to 1:2 and preferably from 1:1 to 1:1.7.

Various chlorinated compounds of isocyanuric acid, such as preferably trichloroisocyanuric acid (TICA), but also Na/K-dichloroisocyanurate, Na-dichloroisocyanurate dihydrate (Na-DCC-2 $H_2O$), Na-monochloroamidosulfonate (=N-chlorosulfamate) and sodium N-chloro-p-toluene sulfonamide ("Chloramine T") may be used as organic active chlorine donors in the layer provided for the main wash cycle. Inorganic active chlorine donors, such as for example, chloride of lime, lithium or calcium hypochlorite, may also be used. They are used in quantities of from 0.2 to 4% by weight, based on the active chlorine content, which may be determined for example by iodometric titration, and on the weight of the layer as a whole.

The block-form detergent layer has a total water content of from 11 to 35% by weight and preferably of from 18 to 30% by weight. The water is preferably introduced by the water of crystallization of the alkaline-reacting substances. Accordingly, calculation of the water content has to be based on those compounds.

It is known that compounds which give off active chlorine enter into decomposition reactions with various organic compounds, such as most surfactants, whereas inorganic salts have hardly any effect on the stability of the active chlorine compounds. Accordingly, the layer formation according to the invention may also be used with particular advantage for the separation of incompatible components. Thus, in addition to the active chlorine compound in the layer provided for the main wash cycle, a surfactant component may advantageously be accommodated in the layer provided for the prerinse cycle. In this way, the wetting effect in the prerinse cycle is enhanced and the soil incipiently dissolved by the alkalis is better penetrated.

Suitable surfactant components are the known low-foaming nonionic surfactants, such as the ethoxylation products of long-chain alcohols and alkylphenols, the free hydroxyl groups of the polyethylene glycol ether residue being replaceable by ether or acetal residues in order to reduce the tendency towards foaming. Block polymers of ethylene oxide with propylene oxide are also suitable. The surfactants may make up from 1 to 5% by weight, and preferably from 1 to 4% by weight, of the total weight of the layer provided for the prerinse cycle.

Small quantities of dyes may optionally be added to the detergent layer provided for the prerinse cycle.

Determination of the dissolving rate of the substances for the individual layers of the fused-block detergents was carried out in a laboratory apparatus after solidification of the raw material melts. To this end, 15 g of the detergent to be tested, in the form of a solid compact block measuring approximately 25×95×15 mm, were introduced into a 250 ml washing bottle according to DIN 12 596 of borosilicate glass. The washing bottle was then closed with a Drechsel stopper and secured in a ground-glass holder. Water at an average temperature of 15° C. corresponding to the prerinse cycle was passed through the bottle at a rate of 20 liters per hour (1/hr) and the quantity which had dissolved under these conditions was determined by weighing after 15 minutes. The solubility behavior was defined as the dissolving rate in grams per hour (g/h) (cf. Table 1, quantities in % by weight).

The results show that the solubility behavior may be varied within wide limits through the particular choice of the starting materials. The addition of surfactants, which provide for improved wetting, has only a minimal effect on solubility. The same also applies to the addition of small quantities of electrolytes.

TABLE 1

(quantiites in % by weight)

| Ingredients | Formulation 1 | 2 | 3 | 4 | 5 | 6 | 7 | 8 | 9 | 10 | 11 | 12 | 13 | 14 | 15 |
|---|---|---|---|---|---|---|---|---|---|---|---|---|---|---|---|
| Na—metasilicate. 9 $H_2O$ | 36 | 44 | 50 | 100 | 70 | 70 | 45.9 | 40.3 | 40.3 | 45.9 | 40.3 | 40.3 | 40.3 | 40.3 | 40.3 |
| Na—metasilicate, anhydrous | 14 | — | — | — | 30 | 28 | — | — | — | — | — | — | — | — | — |
| Na—metasilicate. 5 $H_2O$ | 18 | 20 | — | — | — | — | 45.9 | 52.4 | 56.5 | 45.9 | 52.4 | 56.3 | 52.4 | 52.4 | 52.4 |
| Na—triphosphate | 31 | 35 | 49 | — | — | — | — | — | — | — | — | — | — | — | |
| Sodium sulfate | — | — | — | — | — | — | 4.6 | 4.0 | | 4.6 | 4.0 | | 4.0 | | |
| Sodium acetate | — | — | — | — | — | — | — | — | — | — | — | — | — | — | 4.0 |
| Sodium citrate | — | — | — | — | — | — | — | — | — | — | — | — | — | 4.0 | — |
| $C_{12}C_{14}$—fatty alcohol + 2 EO + 4 PO | — | — | — | — | — | 2 | 3.6 | 3.3 | 3.2 | — | — | — | — | 3.3 | — |
| $C_{12}$—$C_{18}$ fatty alcohol + 2 EO + 4 PO | — | — | — | — | — | — | — | — | — | 3.6 | 3.3 | — | — | — | 3.3 |
| $C_{12}$—$C_{18}$—fatty alcohol + 3 EO + 6 PO | | | | — | — | — | — | — | — | — | — | 3.2 | 3.3 | — | — |
| Trichloroiso—cyanuric acid (91% active chlorine) | 1 | 1 | 1 | — | — | — | — | — | — | — | — | — | — | — | — |
| Dissolving rate at 15° C. in g/h | 22.5 main wash cycle | 23 | 20 | 40 | 30 | 28 | 26 | 36 | 32 prerinse cycle | 30 | 28.5 | 32.5 | 30 | 25 | 28 |

EO = moles ethylene oxide, PO = moles propylene oxide

In the preparation of the melt for the prerinse detergent layer, the sodium metasilicate nonahydrate is first heated to about 55° C. and a dye is optionally added for identification. Sodium metasilicate pentahydrate and/or electrolyte and/or anhydrous sodium metasilicate and/or nonionic surfactant is/are then optionally added as quickly as possible with intensive stirring, after which stirring is continued until the melt and the solid particles distributed therein are substantially homogeneous. In addition to the nonahydrate, the melt for the prerinse detergent layer preferably contains at least one of the other compounds mentioned.

In the preparation of the melt for the main wash detergent layer, sodium metasilicate nonahydrate is again first heated to 55° C., all the other constituents containing water of hydration, more especially sodium metasilicate pentahydrate, then anhydrous pentasodium triphosphate, anhydrous sodium metasilicate and, finally, the active chlorine compounds are added with stirring or kneading and homogenized. Pourable melts preferably have viscosities of from about 500 to 1500 mPas, although higher and lower viscosities may also be processed.

The production of the two-layer blocks requires two successive castings.

The melts, in the quantities to be dispensed, are introduced into the mold through a spray nozzle and successively level out in the mold to form a molding having a smooth surface. In one preferred embodiment, the mold consists of a deep-drawn part made, for example, of polyethylene, polypropylene or polyvinylchloride which also serves as a pack. Using standard commercial machines, it is possible in a single operation to draw several molds from sheet-form film which may then be simultaneously filled through corresponding metering units.

The layer corresponding to the smaller proportion of the overall fused block, generally the layer for the prerinse cycle, is preferably cast first. This is favorable because the first layer solidifies or has to be so viscous that, when the second layer is cast, the two layers do not mix with one another. It is sufficient for the first layer to have only superficially hardened or formed a solid skin as a result of cooling. Cooling may be accelerated by standard measures (cooling duct, air convection, etc.).

After the second layer has been poured on, firm adhesion of the two layers to one another is always obtained after solidification of the fused block as a whole, irrespective of the temperature and condition of the first layer.

After the second layer has been poured on, the mold may be closed by a film, preferably a removable film.

Further, the present invention also relates to a process for the production of multilayer, more especially two-layer, block-form detergents, more especially for dishwashing machines, characterized in that, for the melt for the main wash detergent layer, soidum metasilicate nonahydrate is first heated to 55° C. and all the other constituents containing water of hydration, more especially sodium metasilicate pentahydrate, then anhydrous pentasodium triphosphate and anhydrous sodium metasilicate and, finally, the active chlorine compound are added with stirring or kneading and homogenized. The melt for the prerinse detergent layer comprising the sodium metasilicate nonahydrate is also first heated to about 55° C., dye is optionally added for identification and sodium metasilicate pentahydrate, optionally electrolyte, anhydrous sodium metasilicate and nonionic surfactant are then added as quickly as possible with intensive stirring, after which stirring is continued until the melt and the solid particles present therein are substantially homogeneous. The melt of the first layer corresponding to the smaller proportion of the fused block as a whole is preferably cast first into a mold of any shape, preferably a square mold, and is allowed to solidify therein, at least over its surface, by cooling, after which the melt for the second layer is poured on and, finally, the mass as a whole is allowed to solidify to form a two-layer fused block.

Since there are still no suitable dispensers available for this method of using dishwashing detergents in standard commercial dishwashing machines, the fused blocks may be placed as such in a zone which exposes the fused block to the dissolving power of the stream of tapwater, for example in the cutlery basket of a domestic diswashing machine, before the beginning of the prerinse cycle and the automatically controlled dishwashing process subsequently started.

In addition, the present invention also relates to the use of the multilayer block-form detergents for dishwashing in automatic domestic dishwashing machines, characterized in that, before the beginning of the prerinse cycle in the machine, the fused block is introduced into a zone which exposes the fused block to the dissolving power of the stream of tapwater, for example by placing in the cutlery basket, and the automatically controlled dishwashing process is subsequently started up.

Even with difficult soil, such as for example burnt-on milk or baked-on oatflakes, dishes washed in this way show better results than conventionally washed dishes.

EXAMPLE

Composition of 1st layer (approx. 25% of the total fused block) prerinse

| % by weight | ingredients |
|---|---|
| 45.9 | sodium metasilicate.9 $H_2O$ |
| 45.9 | sodium metasilicate, anhydrous |
| 4.45 | sodium sulfate |
| 3.6 | adduct of 2 moles ethylene oxide and 4 moles propylene oxide with 1 mole $C_{12}$–$C_{18}$ fatty alcohol |
| 0.15 | blue dye |

This composition corresponds to Example 10 of Table 1. Composition of 2nd layer (approx. 75% of the total fused block) main wash

| % by weight | ingredients |
|---|---|
| 36 | sodium metasilicate.9 $H_2O$ |
| 14 | sodium metasilicate.5 $H_2O$ |
| 31 | pentasodium triphosphate, anhydrous |
| 18 | sodium metasilicate, anhydrous |
| 1 | trichloroisocyanuric acid |

This composition corresponds to Example 1 of Table 1.

The two melts are separately prepared with intensive stirring in heated stirring vessels. In the case of the first layer composition, the nonhydrate was first melted and tempered to approx. 55° C. and the dye subsequently stirred in. The anhydrous metasilicate and sodium sulfate were then stirred in with continued intensive stirring. The surfactant was added last and the melt obtained was homogenized at 55° to 60° C. In the case of the second layer composition, the nonahydrate was tempered to 57° C. The metasilicate pentahydrate, the anhydrous triphosphate and the anhydrous metasilicate were then stirred in as quickly as possible in that order and the temperature adjusted to 57°–60° C. To obtain homogeneous, pourable solids-containing melts, the melts had to be intensively stirred with a powerful stirrer. The trichloroisocyanuric acid was stirred in just before the beginning of casting.

12.5 g of the 1st layer composition were poured at 57° to 60° C. into a deep-drawn part of polyethylene film (base area 37×34 $mm^2$, depth 22 mm) of which the side walls were inclined at an angle of approximately 5° relative to the vertical (mold widens upwards). A thin, solidified film had formed on the surface after 1.5 to 2 minutes, so that the second layer composition (37.5 g) could be poured on (57° C.). A fused block comprising two optically separate, but firmly joined layers was obtained after solidification. No intermixing had occurred.

Any multilayer fused-block detergents may be similarly prepared, for example with the same composition as in the preceding Example for the second layer and with any one of compositions 4 to 15 in Table 1 for the 1st layer. It is possible in this way to produce multilayer block-form detergents wherein the individual layers dissolve at different rates and/or wherein the incompatible constituents, for example surfactants and active chlorine donors, separate from one another at different temperatures. The second layer may also have any of the compositions according to German patent application P No. 35 19 354.9. The thickness of the individual layers may readily be varied with the determined dissolving rate of the composition for the 1st layer.

We claim:

1. A block-form multilayer detergent composition for dishwashing machines based on alkaline components selected from the group consisting of alkali metal metasilicates and pentaalkali metal triphosphates; an active chlorine compound; and surfactant; said block-form multilayer detergent composition comprising a cold water-soluble layer (1) containing from about 1 to about 5% by weight of a low-foaming nonionic surfactant, from about 20 to about 100% by weight of sodium metasilicate nonahydrate, from about 0 to about 60% by weight of sodium metasilicate pentahydrate, and from about 0 to about 60% by weight of anhydrous sodium metasilicate, based on the weight of said layer (1); and a warm-soluble layer (2) containing from about 5 to about 50% by weight of anhydrous pentasodium triphosphate, from about 5 to about 60% by weight of sodium metasilicates, expressed as anhydrous compounds, and from about 11 to about 35% by weight of water, wherein the weight ratio of said pentasodium triphosphate to said metasilicates is from about 2:1 to 1:2, based on the weight of said layer (2), said layer (1) and said layer (2) being fused to each other, and wherein said layer (1) has a dissolving rate of from about 25 to about 40 grams per hour at about 15° C., and said layer (2) has a dissolving rate of less than about 25 grams per hour at about 15° C.

2. A block-form detergent composition in accordance with claim 1 wherein said warm water-soluble layer (2) contains from about 0.2 to about 4% by weight of an active chlorine compound, based on the weight of said layer (2).

3. A block-form detergent composition in accordance with claim 1 wherein said cold water-soluble layer (1) comprises differently hydrated alkali metal metasilicates and has a dissolving rate of from about 25 to about 40 grams per hour at about 15° C., and said warm water-soluble layer (2) comprises sodium metasilicates and anhydrous pentasodium triphosphate and has a dissolving rate of less than about 25 grams per hour at about 15° C.

4. A block-form detergent composition in accordance with claim 1 wherein said cold water-soluble layer (1)

contains from about 2 to about 10% by weight of electrolytes, based on the weight of said layer (1).

5. A process for producing a block-form detergent composition useful in dishwashing machines comprising:

(a) heating alkali metal metasilicates to about 55° C. to form a melt thereof;

(b) heating alkali metal metasilicates and pentaalkali metal triphosphate to about 55° C. to form a melt thereof;

(c) casting into a mold said melt formed in step (a) and allowing said melt to at least partially cool and solidify; and (d) casting into the mold used in step (c) the melt formed in step (b) and allowing said melt to at least partially cool, solidify and fuse to said melt formed in step (a).

6. A process in accordance with claim 5 using alkali metal metasilicate nonahydrate in step (a) and step (b).

7. A process in accordance with claim 5 using alkali metal metasilicate nonahydrate in step (a) and step (b) including adding alkali metal metasilicate pentahydrate and optionally anhydrous alkali metal metasilicate.

8. A process in accordance with claim 5 including adding a low foaming nonionic surfactant to said melt formed in said step (a).

9. A process in accordance with claim 5 including adding an active chlorine compound to said melt formed in said step (b).

10. A dishwashing process comprising adding to a dishwashing machine a block-form multilayer composition based on alkaline components selected from the group consisting of alkali metal metasilicates and pentaalkali metal triphosphates; an active chlorine compound; and surfactant; said block-form multilayer detergent composition comprising a cold water-soluble layer (1) containing from about 1 to about 5% by weight of low-foaming nonionic surfactant, from about 20 to 100% by weight of sodium metasilicate nonahydrate, from about 0 to about 60% by weight of sodium metasilicate pentahydrate, and from about 0 to about 60% by weight of anhydrous sodium metasilicate, based on the weight of said layer (1); and a warm water-soluble layer (2) containing from about 5 to about 50% by weight of anhydrous pentasodium triphosphate, from about 5 to about 60% by weight of sodium metasilicates, expressed as anhydrous compounds, and from about 11 to about 35% by weight of water, wherein the weight ratio of said pentasodium triphosphate to said sodium metasilicates is from about 2:1 to 1:2, based on the weight of said layer (2), said layer (1) and said layer (2) being fused to each other, and wherein said layer (1) has a dissolving rate of from about 25 to about 40 grams per hour at about 15° C., and said layer (2) has a dissolving rate of less than about 25 grams per hour at about 15° C.

11. A process in accordance with claim 10 wherein said warm water-soluble layer (2) contains from about 0.2 to about 4% by weight of an active chlorine compound, based on the weight of said layer (2).

12. A process in accordance with claim 8 wherein said cold water-soluble layer (1) comprises differently hydrated alkali metal metasilicates and has a dissolving rate of from about 25 to about 40 grams per hour at about 15° C., and said warm water-soluble layer (2) comprises sodium metasilicates and anhydrous pentasodium triphosphate and has a dissolving rate of less than about 25 grams per hour at about 15° C.

* * * * *